US006364679B1

(12) United States Patent
Gerstberger

(10) Patent No.: US 6,364,679 B1
(45) **Date of Patent: *Apr. 2, 2002**

(54) ROTORLESS HOLDER FOR FLUORESCENT LAMPS

(75) Inventor: Christian Gerstberger, Menden (DE)

(73) Assignee: Vosslom-Schware GmbH, Luedenscheld (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/962,261

(22) Filed: Oct. 31, 1997

(51) Int. Cl.[7] ..... H01R 33/02
(52) U.S. Cl. ..... 439/241; 439/239
(58) Field of Search ..... 439/239–244, 439/226, 229

(56) References Cited

U.S. PATENT DOCUMENTS

| | | | | | |
|---|---|---|---|---|---|
| 2,247,117 | A | * | 6/1941 | Reamer | 439/241 |
| 3,305,823 | A | * | 2/1967 | Dahlhaus et al. | 439/241 |
| 3,328,577 | A | * | 6/1967 | Pisty et al. | 439/226 |
| 3,401,242 | A | * | 9/1968 | McLaughlin | 439/227 |
| 3,651,445 | A | | 3/1972 | Francis | 439/241 |
| 3,681,594 | A | * | 8/1972 | Johnson | 439/226 |
| 3,975,073 | A | | 8/1976 | McLaughlin | 439/241 |
| 4,198,109 | A | * | 4/1980 | Ustin | 439/239 |
| 5,616,042 | A | * | 4/1997 | Raby, Sr. et al. | 439/226 |
| 5,688,139 | A | * | 11/1997 | Gust et al. | 439/239 |

FOREIGN PATENT DOCUMENTS

| | | |
|---|---|---|
| DE | 921 214 | 12/1954 |
| DE | 27 08 426 | 8/1978 |

OTHER PUBLICATIONS

DIN IEC34B/554/CDV, "IEC400: Lampholders for tubular fluorescent lamps and starterholders," Annex C, Sep. 1995.

* cited by examiner

*Primary Examiner*—Hien Vu
(74) *Attorney, Agent, or Firm*—Foley & Lardner

(57) ABSTRACT

A holder provided, in particular, for fluorescent lamps with a two-pin base has a branching insertion slot which preferably has a circular section and, intersecting the latter, a section of rectilinear construction. Arranged on both sides of the bifurcation, which is next to the mouth of the insertion slot and at which the rectilinear part of the insertion slot intersects the circular part of the insertion slot, are latching members which require a force of at least 10 N to be overridden. The latching members act directly on the contact pins of the fluorescent lamp. The result of this is to avoid one contact pin coming into contact with a live contact before the other contact pin has actually been inserted into the holder in a shockproof fashion. Fluorescent lamps are inserted in a conventional way by inserting the contact pins into the rectilinear region of the insertion slot and by rotating the fluorescent lamp by 90°. The fluorescent lamp is withdrawn in the opposite way.

21 Claims, 5 Drawing Sheets

ROTORLESS HOLDER FOR FLUORESCENT LAMPS

BACKGROUND OF THE INVENTION

The present invention relates to a holder for electric devices, in particular, fluorescent lamps with two contact pins.

Tubular fluorescent lamps which are provided at the end with two contact pins are usually held in holders which have a so-called rotor for accommodating the contact pins disposed at the base of the lamp. The rotor is mounted rotatably on the remainder of the lamp holder, and has a slot which can be brought to correspond in alignment with an insertion slot of the holder housing. Moreover, there are arranged in the holder housing resilient contacts with which the contact pins come into contact when the relevant lamp base has been pushed into the holder and rotated by 90° while the rotor is driven. Corresponding holders are widely employed. Both specialists and untrained users therefore mostly assume when changing fluorescent lamps that the fluorescent lamp held in the holders must firstly be rotated by 90° about its longitudinal axis and then withdrawn from the holders.

The holder design is relatively expensive because of the rotatably mounted rotor. Attempts have therefore been made to go over to other types of holder design without rotatable elements, such as disclosed in the published draft of DIN IEC34B/554/CDV, Annex C. In addition to other types of holder design, a holder is presented which has an insertion slot which forks in the shape of a Y. Starting from an open-edged region, the insertion slot branches into two limbs at whose ends electric contacts are arranged for making contact with the contact pins of the lamp base. The spacing of electric contacts from the open-edged region of the insertion slot, which can be accessed by means of test fingers, is larger in this case than the spacing of the contact pins of the lamp base from one another. This is intended to ensure that no live parts are accessible from outside when the contact pins of the lamp base are inserted into the insertion slot of the holder. The two contact pins of the lamp base are interconnected via the incandescent filament present in the lamp. If only one of the contact pins touches a live contact, the other contact pin is therefore also live.

The safety lengths of the insertion slot which are thereby required prescribe a relatively large overall height of the holder. Furthermore, inserting and withdrawing the fluorescent lamps into and from the holder are performed by an unusual cycle of movements, and this can lead in some circumstances to damage to the holders and/or the lamp bases.

SUMMARY OF THE INVENTION

It is an object of the present invention to overcome the foregoing drawbacks and limitations.

It is a further object of the present invention to provide a lamp base which ensures the required shock protection and functions with as few parts as possible.

These objects, and others, are achieved by a holder for an electric device, in particular, a fluorescent lamp, with a two-pin base, comprising: an electrically insulating holder housing having at least one insertion slot on a side facing the base of the device to be held; electric contacts disposed in the holder housing; and latching members which act on a respective contact pin of the device to be held, the latching members being positioned in sections of the insertion slot in which the electric contacts are respectively disposed.

The holder according to the invention, has in its housing a branching insertion slot having two regions. One electric contact is arranged in each region. The electric contacts assigned to the regions extend into the insertion slot. Seen from the side of the insertion slot which is open-edged or opens outward, latching members are positioned in front of the electric contacts which apply a predetermined latching force. If a fluorescent lamp is inserted with its contact pins into the insertion slot in such a way that the contact pins are loaded toward the contacts, the latching members block the passage of the contact pins to the contacts. The latching members thus prevent contact from being made unintentionally with the contact pins, with the result that a contact pin still located outside the holder can be energized only when the contact pin already located in the holder overrides the latching force of the latching members positioned in front of the contact. The latching force is set so as to take account of requirements for electrical safety.

No rotor is required in the holder according to the invention, and so there is a corresponding simplification in the holder design. The holder housing can comprise a few parts (in the simplest case one or two) which accommodate and hold the contacts. If the holder housing is constructed in two parts, the part of the holder housing which faces the device, that is to say the lamp, can be constructed from a more heat-resistant plastic than the remaining part of the holder housing. Both the required heat resistance and cost effective production are achieved as a result, by virtue of the fact that it is possible for only the part of the holder facing the lamp to be constructed, to some extent, as a heat shield, and thus to be constructed from a relatively expensive plastic.

Although other designs are possible in principle, it is advantageous that the insertion slot has a branching point at which, preferably, a rectilinear section of the insertion slot intersects a circular section for accommodating the contact pins. The rectilinear insertion slot then extends from an open-edged point, opening toward the housing side, in a straight line over the side of the holder housing facing the device, intersecting in so doing the circular section and touching at the opposite point. This holder permits conventional handling of fluorescent lamps by firstly pushing the latter into the holder and then rotating them by 90° about their longitudinal axis, in order to fasten and connect them. Withdrawal is performed in the opposite way.

In this design, the latching members are arranged next to the branching point at which the rectilinear part of the insertion slot crosses the circular part of the insertion slot. With the required reliability, they prevent a contact pin from touching a contact while the other contact pin is still located outside the holder. This is achieved without the need for the spacing of the contact from the opening of the insertion slot to be larger than the contact pin spacing. The construction of attractive holders which require little space and material is achieved as a result.

The latching members are preferably constructed in one piece on the holder. housing, it being possible for the latching members to be formed by a flexible housing section which constricts the insertion slot so far that the contact pin can be pushed through this region only with widening of the insertion slot. The resiliently flexible housing sections can be constructed both on one side and on both, mutually opposite, flanks of the insertion slot.

In an advantageous embodiment, a total of four latching members are provided which are respectively arranged in pairs next to the contact. Upon rotation of the device inserted into the holder, the contact pins run through the circular section of the insertion slot and in this way both come into contact in each case with a latching member. This produces a latching torque which is simultaneously distributed over both contact pins. The device is therefore cleanly guided by the holder when rotating about its longitudinal axis.

Independently of the number of latching members, the force required to override each latching member individually is greater than or equal to 10 N. This ensures the required electrical safety.

Latching members can be formed by a spiral spring section which is provided on the holder housing constructed from plastic and at whose free end a latching cam is seated which defines a constriction of the insertion slot. It is possible to provide the latching members on the holder housing with a device for supporting the contact pin in order to absorb the lateral forces acting on the contact pin and emanating from the latching cam, and to guide the contact pin on a clearly defined track in the shape of a circular arc, at least in the region of the latching member. This device can be formed by projections, ribs and other types of bearing surfaces.

The electric contacts are preferably mounted in the insertion slot in such a way that they are resiliently flexible toward its flank. If they are of rectilinear construction, simple contact shapes are ensured, in which case they occupy a relatively long slot region. The latching members ensure shock protection, nevertheless. Moreover, it is possible to provide the contacts with projections, bends or the like which cooperate in a latching fashion with the contact pins.

Further features and advantages of the invention will be apparent from the following description.

DETAILED DESCRIPTION OF THE PREFERRED EMBODIMENTS

Figure 1:
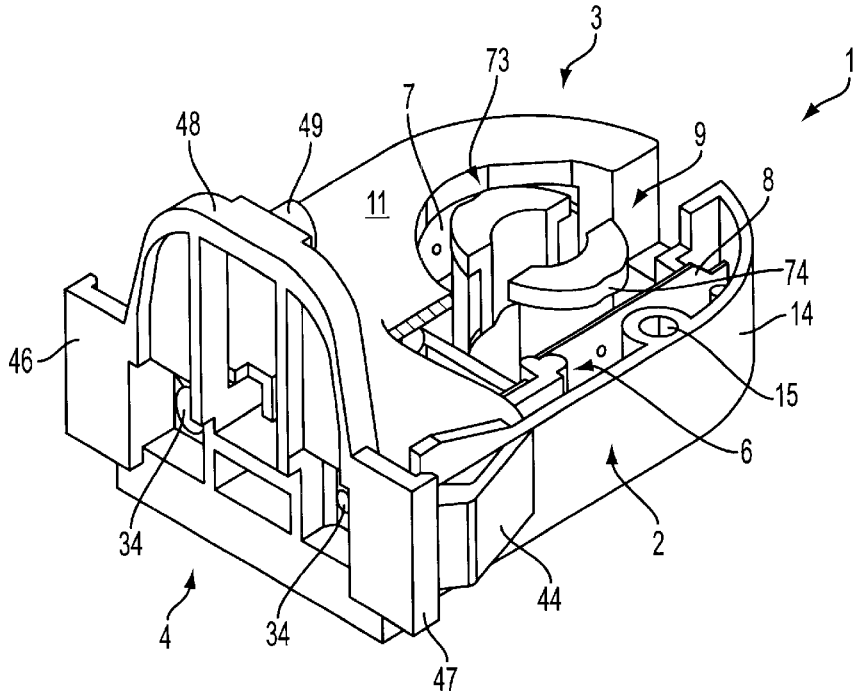
FIG. 1 is a perspective view of a rotorless holder having a two-part holder housing in accordance with an embodiment of the invention.

A holder 1 for fluorescent lamps with two contact pins is illustrated in FIG. 1. The holder 1 has a holder housing 2 which has an essentially plate-shaped holder section 3, which is rounded off on its upper side, and a foot section 4 which adjoins the holder section 3 and is adapted for the purpose of being connected to a luminaire plate or the like. The holder housing 2, and, in particular, the holder section 3 define an interior space 6, in which there are mounted two contacts 7, 8 electrically insulated from one another. The two contacts 7, 8 are disposed parallel to one another in a spaced apart relationship.

An insertion slot 9 for the two contact pins is provided in the holder housing 2. In this example, the insertion slot 9 is defined by a first holder part 11 as shown in FIGS. 1and 3. The first holder part 11 is preferably produced from a heat-resistant plastic such as PBT (poly(butylene terephthalate)). The first holder part 11 may also include a glass fiber component. The first holder part 11 serves as a heat shield.

Figure 3:
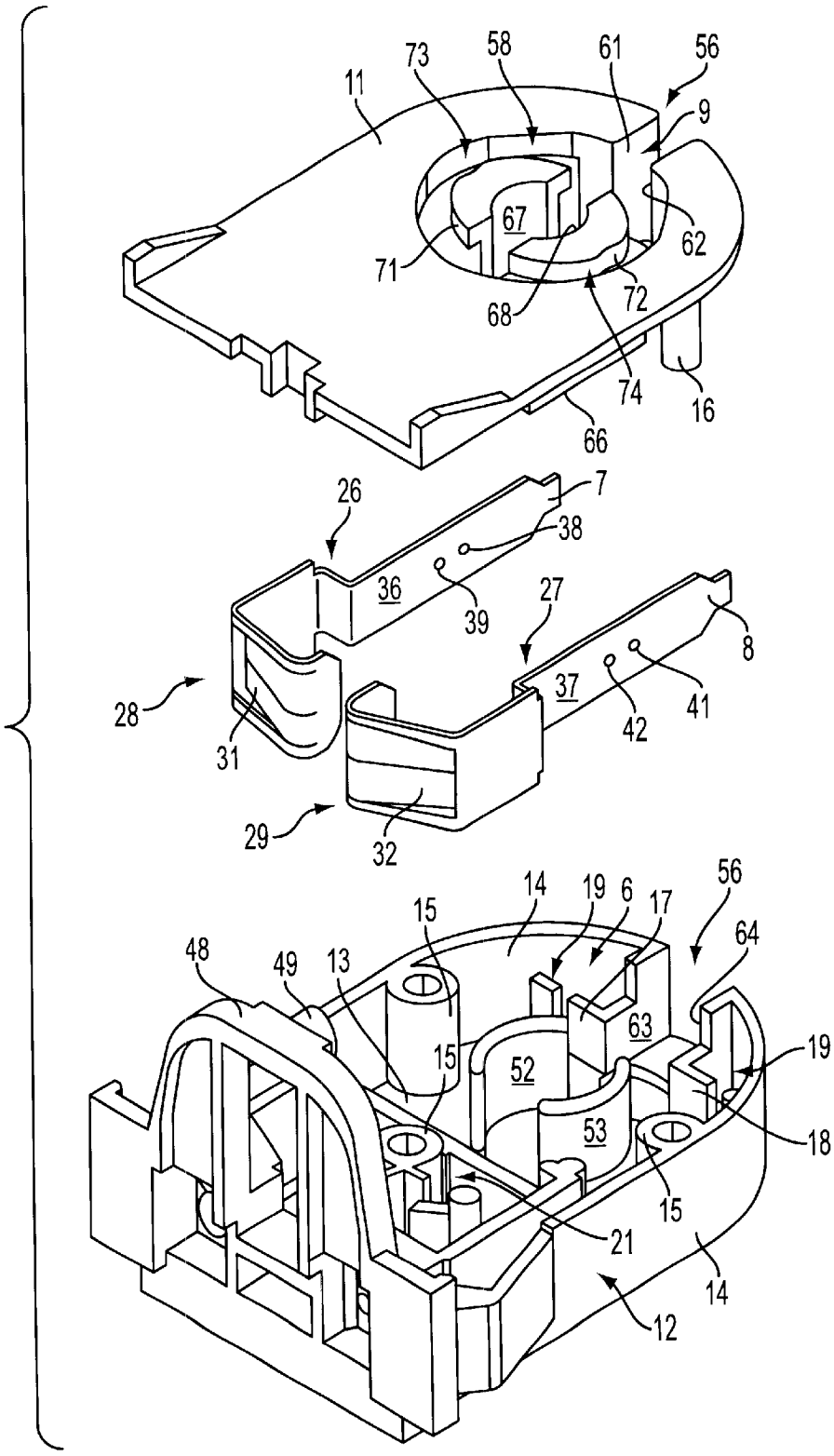
FIG. 3 is an exploded view of the holder according to FIG. 1.

As shown in drawings, the first holder part 11 occupies virtually the entire surface of the holder housing 2 which faces the lamp base. The remaining part of the holder housing 2 is formed by a second holder part 12 (FIG. 3). The second holder part 12 is produced from a plastic which is as cost effective as possible, such as PC (polycarbonate). The second holder part 12 is relatively larger than the first holder part 11 and is constructed in one piece. The second holder part 12 includes a flat base face 13, which forms a rear wall. From the edge of the base face 13 there rises a side wall region 14 in the shape of a U when seen from a top plan view perspective. Integrally formed on the side wall region 14 are socket-like fastening receptacles 15 which serve to accommodate pins 16 constructed on the first holder part 11.

Figure 2:
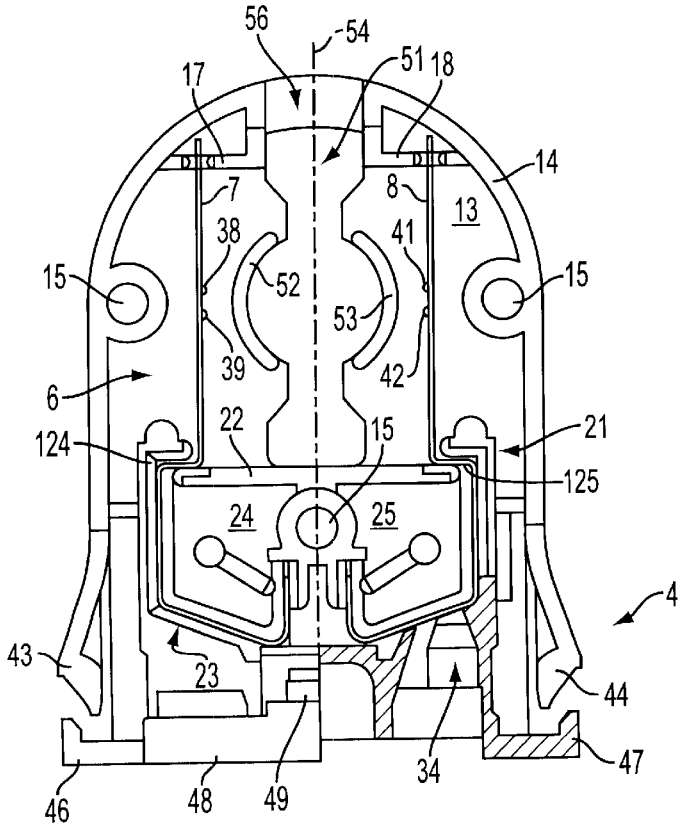
FIG. 2 is a sectional plan view of an underpart of the holder according to FIG. 1.

In order to hold the contacts 7, 8 in the second holder part 12 (shown at the bottom in FIG. 3), the second holder part 12 has two transverse walls 17, 18, which are arranged in the interior space 6. Each transor wall 17, 18 is provided with a slot 19 for accommodating the contact 7, 8. Constructed on the second holder part 12 at a spacing from the transverse walls 17, 18 is a further contact holding arrangement 21 which is shown in FIG. 2. A transverse wall 22 parallel to the transverse walls 17, 18 delimits two connecting spaces 24, 25 for the contacts 7, 8, respectively, by means of a further wall arrangement 23 rising from the base face 13.

The connecting spaces 24, 25, are respectively trapezoidal in plan view. These spaces are 124, 125 each connected via a slot 124, 125 to the remaining interior space 6 of the holder housing 2. Each such slot 124, 125 respectively extends parallel to the transverse wall 22. The contacts 7, 8 are offset in this region, as is indicated in FIG. 3 at 26, 27. The contacts 7, 8 are thereby mounted non-displaceably in the interior space 6.

The contacts 7, 8 are held at their ends during use in the connecting spaces 24, 25 with a spring clamping connection 28, 29. The spring clamping connections 28, 29 include respective contact tongues 31, 32 that make electrical contact with, and mechanically hold a stripped wire (not shown), which is pushed through an opening 34 in the holder housing 2. The contacts 7, 8 are other wise constructed rectilinearly, in particular in the sections designated by reference numerals 36, 37, which extend through the interior space 6. Since the contacts 7, 8 are held only at the transverse wall 22 and the transverse walls 17, 18, they are free in the middle, with the result that they can bend outward resiliently. Two knobs 38, 39, 41, 42, which can be obtained, for example, by pressing in from the respective rear side, are respectively constructed approximately in the middle on the rectilinear sections 36, 37.

The second holder part 12 is provided on both sides at its foot section 4 with latching tongues 43, 44. Opposite to the latching tongues 43,44 are situated corresponding, spaced apart abutments 46, 47 formed by webs which project to the side.

For the purpose of further aligning and holding the holder 1 on a luminaire plate, the foot section 4 can be provided with a section 48 which extends at right angles to the base face 13 and projects in the assembled state beyond the holder part 11, and on which a pin-like projection 49 is constructed.

Guide cheeks 52, 53, which extend at right angles to the base face 13, are constructed in the interior space 6 on edges, in the shape of circular arcs, of an opening 51 penetrating the base face 13. The guide cheeks 52, 53 are arranged in this case at a spacing from the respectively neighboring contact 7, 8, approximately in the middle relative to its rectilinear section 36, 37, which is smaller than the diameter, smallest in tolerance, of a contact pin of a fluorescent lamp with which contact is to be made. The mutual spacing of the outer surfaces, pointing toward the respective contact 7, 8, of the guide cheeks 52, 53, that is to say the diameter of the circle defined by these surfaces, is precisely as large as or slightly smaller than the clear width between two contact pins of a lamp base.

The second holder part 12 is designed symmetrically with respect to a longitudinal middle plane 54. Its side wall region 14 is interrupted on its upper side at 56. The second holder part 11 is constructed essentially without undercuts, with the result that it can be produced using injection molding technology with a simple mold which, for example, has only one split.

The holder part 11 that attaches to the second holder part 12 (shown in FIGS. 1 and 3) is essentially constructed in the shape of a plate and defines the shape of the insertion slot 9. The contour of the first holder part 11 is adapted to the side wall region of the second holder part 12 and is approximately U-shaped in plan view. The first holder part 11 is provided, in the region where the lamp base is to be held, with an approximately round opening 58 which defines the outer edge of the insertion slot 9 and opens upward at the portion of the slot 9 designated by reference number 56. Extending in this region toward the base face 13 of the holder part 12 are two limbs 61, 62 running at a spacing parallel to one another and being interconnected at their free end. The limbs 61, 62 bear against corresponding flanks 63, 64 of the second holder part 12 when the first and second holder parts 11, 12 are mounted on one another. Proceeding from the free ends of the limbs 61, 62, a support section 66 extends backwards, at a spacing parallel to the front side of the first holder part 11, over the entire diameter of the opening 58 and with a section which is not further represented to the plate-shaped part of the first holder part 11. Ea the assembled state, the support section 66 is seated in the opening 51.

Two spring elements 67, 68, which are constructed in the shape of grooves and have a collar 71, 72 extending radially outward on their upper end arranged inside their opening 58, are constructed in one piece on the support 66. The collar 71, which extends outward like a flange, is shaped on its outside such that it forms a double notch 73 together with the edge of the opening 58 and the spring element 67. The same holds for the collar 72, which likewise defines a double notch 74 with the spring element 68 and the edge of the opening 58.

In accordance with the geometry (illustrated in FIG. 4), of the insertion slot 9, the insertion slot 9 has a rectilinearly constructed section 91 and a circular section 92. The rectilinear section 91 intersects the circular section 92 at a branching point 93, then runs along a diameter of the circle defined by the circular section 92, and meets that circle at a point 94.

Figure 4:
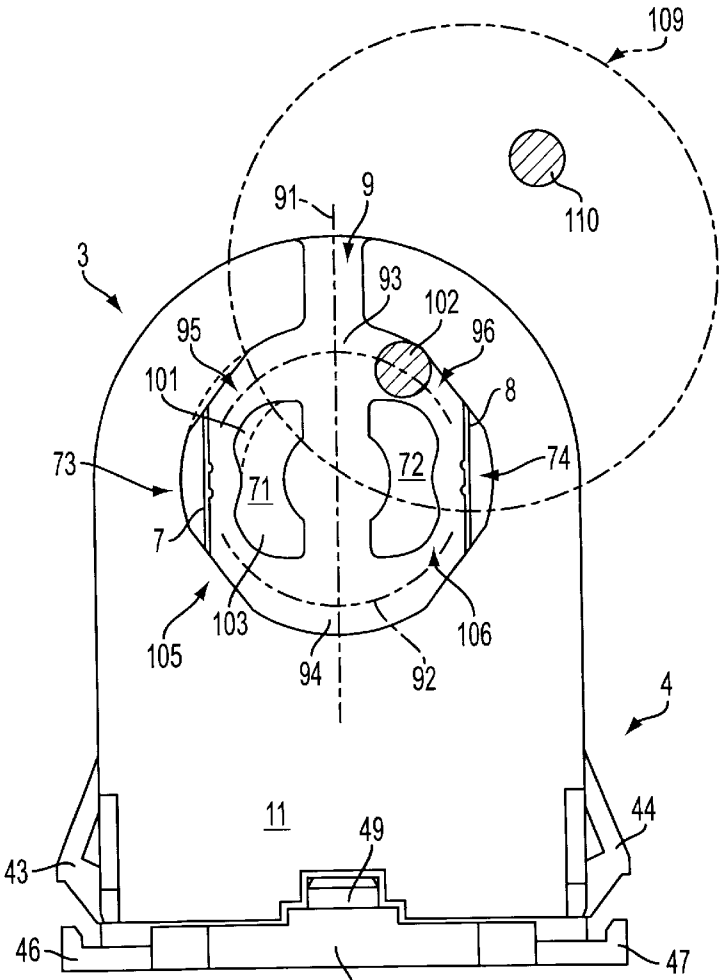
FIG. 4 is a representation of the holder according to FIGS. 1 to 3 which illustrates the occurrence of a defective insertion of the base of a fluorescent lamp.
Figure 5:
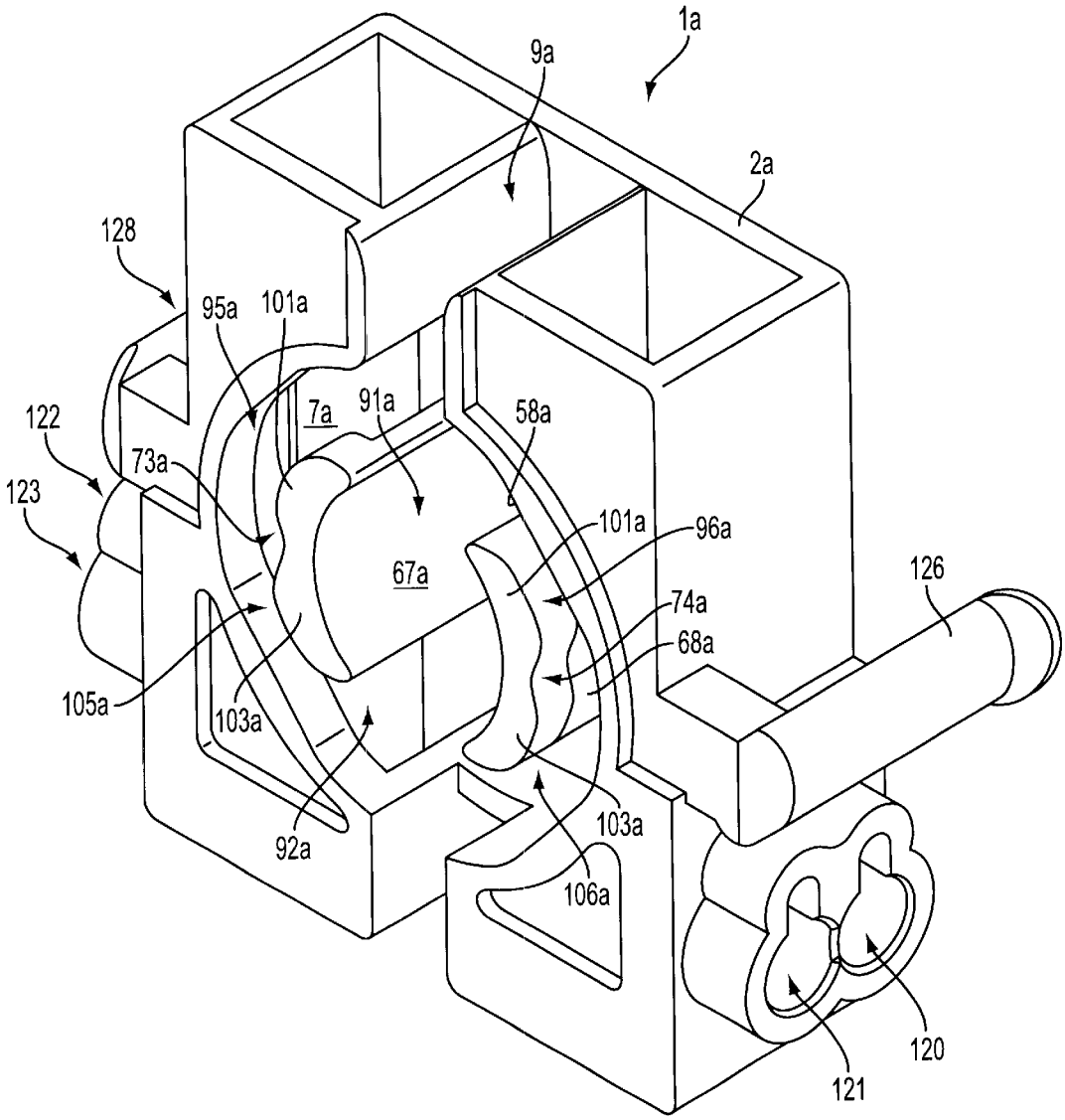
FIG. 5 is an enlarged perspective view of a rotorless holder according to another embodiment of the invention.
Figure 9:
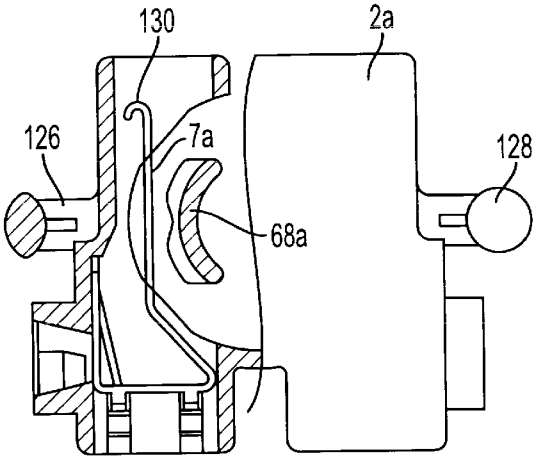
FIG. 9 is a sectional rear view of the holder according to FIGS. 5 to 8.
Figure 8:
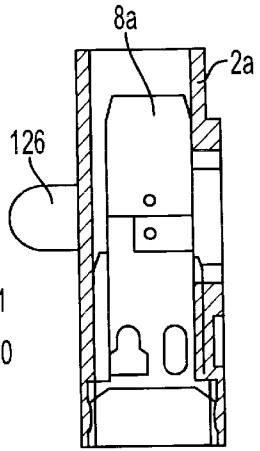
FIG. 8 is a sectional view of the holder according to FIGS. 5 to 7.

On both sides of the branching point 93, the insertion slot 9 is constricted by latching maembers 95, 96. In this example, the latching member 95 is formed by a cam projection 101 formed on the collar 71 and a narrowing or constriction of a portion of the circular section 92 opposing the cam projection 101. Spefcifically, as shown in FIG. 4, an edge portion near opening 58 deviates from a circular shape to form a constriction formed as a chord. As illustrated by dashed lines, the chord resiliently constricts the circular section 92. Opposing the chord section, the collar 71 has a cam projection 101 ithat also constricts the insertion slot. As noted above, th collar 71 is held by a spring eleinent 67, and thus the collar also resiliently constricts the circular section of the inserion slot. A second latching member 96 is similarly formed by a narrowing of the circular section 92 formed opposite to a cam projection collar 72, which collar 72 is held by spring element 68. In this example, the constrictions and the spring elements 67, 68 which form lating members 95, 96 are constructed to prevent a contact pin 102 from passing to contacts 7, 8 until application of a force of at least 10 N in the direction of movement of the pins.

In the example shown in FIG. 4, a third latching member 105 is formed by another cam projection 103 on collar 71 and a narrowing or constriction of a portion of the circular section 92 disposed opposite the projection 103. A fours latching member 106 is for by another cam projection on collar 72 and another narrowing or constriction of a portion of the circular section 92 opposed to the cam projection. Thus, latching members 95 and 105 are located on opposing sides of contact 7. Latching members 96 and 106 are located symmetrically on opposing sides of contact 8.

The holder 1 described to this extent functions as follows:

To insert a fluorescent lamp 109 into the holder 1, the lamp is inserted with its contact pins 102, 110 into the rectilinear section 91 of the insertion slot 9 until the contact pin 102 is at the bifurcation 94, and the contact pin 110 is at the bifurcation 03. By rotating the fluorescent lamp 109 with a corresponding torque by 90° about the longitudinal axis, the contact pin 102 overrides the resilient latching member 105, and the contact pin 110 overrides the resilient latching member 96. As the contact pins 102, 110 move, they are guided by the guide cheeks 52, 53. The contact pins 102, 110 press the resilient contacts 7,8 to the side, as a result of which they fit tightly and an electrical contact is produced. While the contact pin 102 is held in a latching fashion in contact position between the projections 101 and 103, the contact pin 110 is held between corresponding projections formed on collar 72. The lamp is now ready to operate.

To withdraw the fluorescent lamp 109, the latter is rotated in turn by 90° in any direction about its longitudinal axis, as a result of which the contact pins 102, 110 are rotated into the rectilinear section 91 of the insertion slot 9 while overriding the neighboring latching members 95, 106 or 105, 96. The lamp 109 can now be withdrawn.

Both when being inserted and when being withdrawn, the contact pins 102, 110 do not touch any live part when they are pushed into the rectilinear section 91 or withdrawn therefrom. Live parts cannot be touched.

If, however, because of an operating error, for example, the contact pin 102 is pushed into the circular section 92 of the insertion slot, while the other contact pin 110 is still located outside the holder, the resilient latching members 96, 95 prevent the contact pin 102 from advancing as far as the respective contact 8, 7. The respective latching members 96, 95 ensures in this case that a sufficient safety spacing to the respective contact 8, 7 is observed, even if the contact pin is pressed with forces of up to 10 N in the direction of the respective contact 8, 7. The required electrical safety is provided thereby even in the case of faulty operation.

Figure 6:
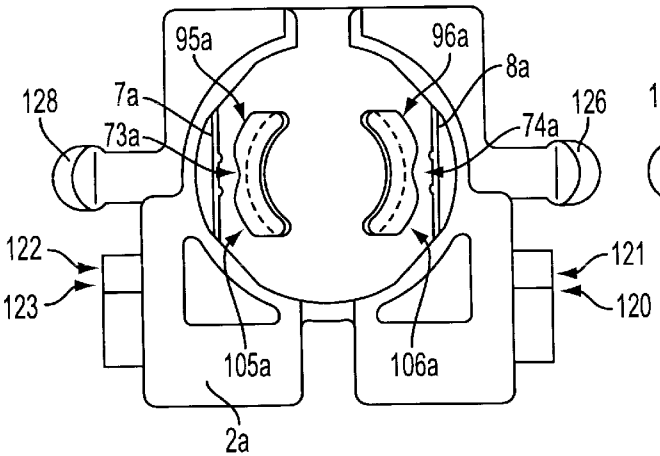
FIG. 6 is a front view of the holder according to FIG. 5.
Figure 7:
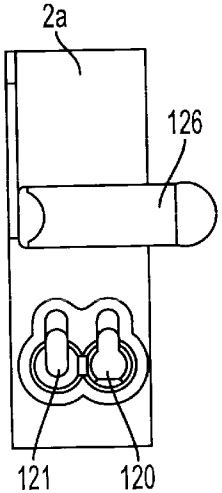
FIG. 7 is a side view of the holder according to FIGS. 5 and 6.

A further exemplary embodiment of a invention is illustrated in FIGS. 5 to 9, in the form of a holder 1*a*. Like the holder 1 described above, the holder 1*a* is also a rotorless holder. Unlike holder 1, holder 1*a* has a holder housing 2*a* constructed in one piece. Seen from the opposite side shown in FIG. 5, the housing 2*a* is free from undercuts. The housing 2*a* has an insertion slot 9*a* which has a rectilinearly constructed section 91*a* and a circular section 92*a*, which intersect one another as in the exemplary embodiment described above and shown in FIG. 4. The insertion slot 9*a* is bounded in its circular section 92*a* by the edge of the opening 58*a*. Constructed on the holder housing 2*a* are radially resilient tongues 67*a*, 68*a* at whose free ends positioned inside the opening 58*a* cam projections 101*a*, 103*a* constricting the insertion slot 9*a* (92*a*) are constructed. The tongues 67*a*, 68*a* radially inwardly bound the circular section of the insertion slot with their cam projections 101*a*, 103*a*. A total of four latching members 95*a*, 96*a*, 105*a*, 106*a* are constructed as a result. A contact 7*a* projects into the insertion slot 92*a* between the latching members 95*a*, 105*a*. The contact 8*a* is arranged correspondingly (FIG. 6).

For the purpose of connecting the contacts 7*a*, 8*a* to external wiring, provision is made on the sides of the holder body 2*a* of connecting openings 120, 121, 122, 123 which lead directly to corresponding spring clamping contacts of the contacts 7*a*, 8*a*. Arranged, furthermore, on the sides of the holder housing 2*a* are latching fingers 126, 128 which permit the holder la to be fastened to a suitable support.

The mode of operation of this holder largely corresponds to that of the holder described above, the resilient contacts 7*a*, 8*a* being held at their upper, free end not in a transverse wall, but only by bearing against a side wall of the holder housing 2*a*. As may be seen from FIG. 9, the contact 7*a* is therefore bent over at its free end 130 in order to find an abutment on the wall of the holder. As a result of this measure, as mentioned the entire holder 1*a* can be designed from the point of view of production engineering to be approximately free of undercuts from below, and so it can be produced as a simple injection-molded part with a simple shape.

The holder housing la is, moreover, particularly small. The spacing from the top side of the holder housing 2 of the points at which a contact pin can touch the contact 7*a* or 8*a* for the first time is smaller than the spacing between the contact pins. The latching members 95*a*, 96*a* ensure shock protection.

Figure 10:
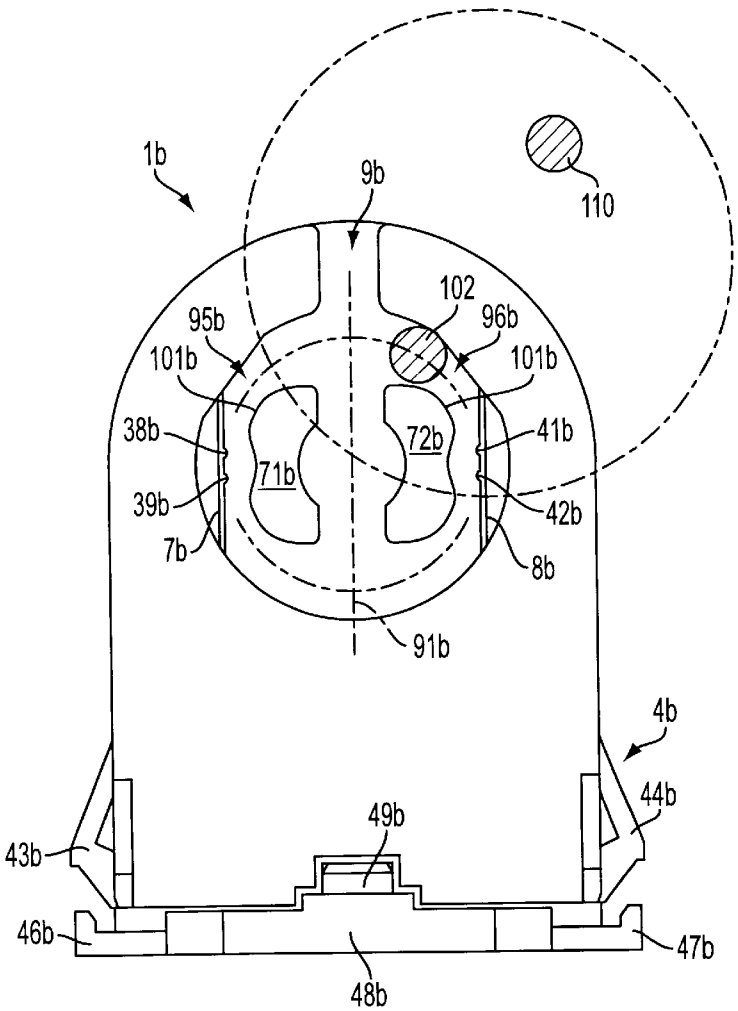
FIG. 10 is a representation of a holder according to another embodiment of the invention which illustrates the occurrence of an attempted defective insertion of a fluorescent lamp.

A modified holder 1*b* is illustrated in FIG. 10, the holder 1*b* corresponding largely to the holder 1. Without renewed reference, use is therefore made of the reference numerals of the holder 1 provided with a "b" to distinguish them, their description being correspondingly valid here. The differences reside essentially in that only two latching members 95*b*, 96*b* are provided; otherwise no further latching members are provided in the course of the circular section 92*b* of the insertion slot 9*b*. This is achieved by virtue of the fact that the collars 71*b*, 72*b* serving as cam elements in each case have only one upper projection 101*b*, but no lower projection. The edge of the opening 58 is constructed in this example without a constriction of the circular section 92*b* of the insertion slot 9*b*, in a fashion lying on a circular arc. A corresponding statement holds for the opposite regions of the cams or collars 71*b*, 72*b*.

The contact pins 102, 110 of the fluorescent lamp 109 are in this case latched in the operating position by the latching members 95*b*, 96*b* as well as by the action of the contacts 7*b*, 8*b*, which deflect outward resiliently, and their knobs 38*b*, 39*b*, 41*b*, 42*b*.

A holder provided in particular for fluorescent lamps with a two-pin base has a branching insertion slot which preferably has a circular section and, intersecting the latter, a section constructed rectilinearly. On both sides of the bifurcation which is next to the mouth of the insertion slot and at which the rectilinear part of the insertion slot intersects the circular part of the insertion slot, latching members are arranged which require a force of at least 10 N to be overridden. The latching members act directly on the contact pins of the fluorescent lamp. This prevents a contact pin from touching a live contact before the other contact pin has actually been inserted into the holder in a shockproof fashion.

Handling the holder, that is to say inserting fluorescent lamps, is performed in the usual way by inserting the contact pins into the rectilinear insertion slot region, and by rotating the fluorescent lamp by 90°. The fluorescent lamp is withdrawn in the opposite way.

Exemplary embodiments have now been described in fulfillment of the foregoing objects of the invention. It will be understood that many different variations and modifications will be apparent to those skilled in the art which do not depart from the spirit or scope of the invention.

What is claimed is:

1. A holder for an electric device having two contact pins, said holder comprising:

an electrically insulating holder housing having a side facing the electric device to be held;

an insertion slot adapted to receive the contact pins of the electric device, the insertion slot being formed in the side of the housing facing the electric device to be held, and the insertion slot being comprised of a circular section and a rectilinear section that intersects the circular section to form a branching point;

electric contacts disposed within the holder housing, wherein a portion of each electric contact for contacting the pins of the electric device is disposed along the circular section of the insertion slot; and latching members positioned along the circular section adjacent to the portions of the electric contacts for contacting the pins of the electric device, the latching members resiliently constricting the circular section of the insertion slot, thereby providing a force on one of the contact pins of the electric device upon insertion of the contact pins into the holder housing, which force must be overcome for the pin to contact the electric contacts;

wherein the latching members are electrically insulated from the electric contacts.

2. The holder as claimed in claim 1, wherein the holder housing is formed of two parts, wherein a first part which faces the device to be held acts as a heat shield.

3. The holder as claimed in claim 1, wherein the holder housing is formed of a single part without undercuts.

4. The holder as claimed in claim 1, wherein the latching members are disposed adjacent to the branching point.

5. The holder as claimed in claim 1, wherein the latching members are disposed along the circular section of the insertion slot.

6. The holder as claimed in claim 5, wherein at least two latching members are disposed on mutually opposite sides of the rectilinear portion of the insertion slot.

7. The holder as claimed in claim 1, wherein the holder is constructed without a rotor.

8. The holder as claimed in claim 1, wherein the latching members each comprise one or more flexible sections of the holder housing which constricts the insertion slot.

9. The holder as claimed in claim 8, wherein two electric contacts are disposed within the holder housing on mutually opposite sides of the insertion slot and wherein at least two latching members are disposed adjacent to each contact.

10. The holder as claimed in claim 1, wherein the latching members comprise four latching members.

11. The holder as claimed in claim 10, wherein the four latching members are disposed along the circular section of the insertion slot.

12. The holder as claimed in claim 1, wherein each latching member blocks a contact pin from further entering the insertion slot until a force of at least 10 N is applied to the latching member.

13. The holder as claimed in claim 1, wherein the latching members are constructed in one piece with the holder housing.

14. The holder as claimed in claim 1, wherein the latching members each comprise flexible side portions of the holder housing disposed within the circular section opposite to a cam projection disposed on a free end of a spring element that is affixed to the holder housing.

15. The holder as claimed in claim 1, further comprising guide cheeks disposed within the insertion slot and spaced apart from the contacts, said guide cheeks supporting the contact pins of the electric device.

16. The holder as claimed in claim 15, wherein the housing includes spring elements disposed within the insertion slot, the spring elements having a base region affixed to the holder housing that form the guide cheeks that support the contact pins of the electric device.

17. The holder as claimed in claim 16, wherein the base region of each spring element is essentially inflexible.

18. The holder as claimed in claim 1, wherein the portion of the electric contacts for contacting one of the pins of the electric device are resiliently flexible.

19. The holder as claimed in claim 1, wherein the portion of the electric contacts for contacting one of the pins of the electric device has a rectilinear shape.

20. The holder as claimed in claim 1, wherein the portion of the electric contacts for contacting one of the pins of the electric device includes knobs to hold the pins of the electric device.

21. The holder as claimed in claim 1, wherein the electric device is a fluorescent lamp.

* * * * *

UNITED STATES PATENT AND TRADEMARK OFFICE

CERTIFICATE OF CORRECTION

PATENT NO. : 6,364,679 B1
DATED : April 2, 2002
INVENTOR(S) : Christian Gerstberger It is certified that error appears in the above-identified patent and that said Letters Patent is hereby corrected as shown below:

Title page,
Item [73], Assignee, please change "Vosslom-Schware GmbH" to
-- Vossloh-Schwabe GmbH --.

Signed and Sealed this

Twenty-seventh Day of May, 2003

JAMES E. ROGAN
*Director of the United States Patent and Trademark Office*